US006575153B2

(12) United States Patent
Lommasson et al.

(10) Patent No.: US 6,575,153 B2
(45) Date of Patent: Jun. 10, 2003

(54) ARCHERY BOWS, ARCHERY BOW CAM ASSEMBLIES AND METHODS OF ADJUSTING AN ECCENTRIC PROFILE OF AN ARCHERY BOW CAM ASSEMBLY

(75) Inventors: Paul G. Lommasson, Waitsburg, WA (US); Dan J. Martin, Walla Walla, WA (US)

(73) Assignee: Martin Archery, Inc., Walla Walla, WA (US)

( * ) Notice: Subject to any disclaimer, the term of this patent is extended or adjusted under 35 U.S.C. 154(b) by 38 days.

(21) Appl. No.: 09/826,587

(22) Filed: Apr. 4, 2001

(65) Prior Publication Data

US 2002/0144675 A1 Oct. 10, 2002

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS

| | | | | |
|---|---|---|---|---|
| 4,774,927 A | * | 10/1988 | Larson | 124/25.6 |
| 5,174,268 A | | 12/1992 | Martin et al. | 124/25.6 |
| 5,368,006 A | | 11/1994 | McPherson | 124/25.6 |
| 5,505,185 A | | 4/1996 | Miller | 124/25.6 |
| 5,678,529 A | * | 10/1997 | Larson | 124/25.6 |
| 5,782,229 A | | 7/1998 | Evans et al. | 124/25.6 |
| 5,791,322 A | | 8/1998 | McPherson | 124/25.6 |
| 5,890,480 A | | 4/1999 | McPherson | 124/25.6 |
| 5,960,778 A | * | 10/1999 | Larson | 124/25.6 |
| 5,975,067 A | | 11/1999 | Strother | 124/25.6 |
| 6,250,293 B1 | * | 6/2001 | Andrews | 124/25.6 |
| 6,360,735 B1 | * | 3/2002 | Larson | 124/25.6 |

OTHER PUBLICATIONS

Martin Archery Inc., Owner's Manual, entire manual, for Dyndbo.
Browning Archery, Products Catalog, date unknown, p. 105.

* cited by examiner

*Primary Examiner*—John A. Ricci
(74) *Attorney, Agent, or Firm*—Wells St. John P.S.

(57) ABSTRACT

In one aspect, the invention includes an archery bow cam assembly having a first body and a second body discrete from the first body. The first body defines a first portion of a sheave having an eccentric profile and the second body defines a second portion of the sheave. The second body is pivotally supported on the first body and is adjustably oriented relative to the first body for adjusting the eccentric profile. In another aspect, the invention includes an archery bow having a first limb, a second limb and a handle between the limbs. At least one rotating member is rotatably joined to at least one of the limbs, and the rotating member defines a first portion of a sheave having an eccentric profile. A body discrete from the rotating member defines a second portion of the sheave. The body is pivotally supported on the rotating member and is adjustably oriented relative to the rotating member for adjusting the eccentric profile. A string extends between the first and second limbs.

30 Claims, 12 Drawing Sheets

ARCHERY BOWS, ARCHERY BOW CAM ASSEMBLIES AND METHODS OF ADJUSTING AN ECCENTRIC PROFILE OF AN ARCHERY BOW CAM ASSEMBLY

TECHNICAL FIELD

This invention pertains to archery bows, archery bow cam assemblies and methods of adjusting an eccentric profile of an archery bow cam assembly.

BACKGROUND OF THE INVENTION

Various types of archery bows have been developed, including traditional bows (i.e., long bows and recurved bows) and compound bows. The archery bows include a pair of opposed limbs extending from a handle of the bow. As an archer draws the bow by pulling on a drawstring, the limbs flex and store energy. This energy is transferred to the arrow as the archer releases the drawstring.

A compound bow is a popular design for archery bows and comprises incorporating one or more cams (for example, eccentric wheels or pulleys) into the bow. These bows use a cable system which extends over at least one cam rotatably mounted at a distal end of a bow limb to provide a mechanical advantage during a draw of the drawstring (i.e., pulling back the drawstring from an initial stationary position). That is, the force required to move the drawstring (i.e., the draw force) varies as a function of the draw position of the drawstring from the initial position of the drawstring as an archer begins to pull back the drawstring to the final draw position of the drawstring where the archer holds the drawstring just before release. The draw force is initially high, reaching a peak draw force (i.e., a peak pull force on the drawstring to maintain the draw) routinely past the midpoint of a final draw position, for example; and as the drawstring approaches the final draw position, the draw force decreases.

With this arrangement, when the drawstring is in the final draw position, maximum potential energy is stored in the bow while the force required to maintain the drawstring in the final draw position is less than the maximum draw force of the bow. In short, as the drawstring is being drawn, the draw force applied to the bow increases to a maximum force and then reduces to a lower draw force at the final draw position. Accordingly, maximum potential energy is stored in the limbs without requiring maximum draw force to hold the drawstring in the final draw position. This permits the archer to maintain aim on his target prior to release for a longer period of time for a better shot. Such a draw force decrease during the draw is referred to as the "let off" percentage. For example, if the maximum draw force of an exemplary bow is 80 pounds, and the bow has a 65% let off percentage, then at the final draw position the draw force needed to hold the drawstring static is 35% (100%−65%=35%) of 80 pounds which equals 28 pounds.

A problem in the archery bow industry is different states may have different regulations requiring different let off percentages and/or one state may have different regulations regarding let off percentages for different archer bow activities carried out within the state. For example, one state may allow a maximum let off percentage for hunting and allow a different maximum let off percentage for archery competitions.

Accordingly, a goal in the archery industry is to design compound bows which provide methods for varying let off percentages.

Another goal of the archery industry is to design compound bows which provide methods for varying draw lengths. A draw length is defined as the distance from the center of a handle riser of a bow to a drawstring in a maximum draw position at the point of the drawstring where the archer's fingers are holding the drawstring in the maximum draw position. The ability to vary draw lengths can be important to accommodate different arm lengths of an archer.

To reach either of the above discussed goals (i.e., varying let off percentages and varying draw lengths), different bows suited for the different purposes could be provided. For example, if an archer wished to have a particular let off percentage for hunting, the archer would use one bow for hunting and use another bow with a different let off percentage for another purpose. The same solution can be use for changing draw lengths. However, having several bows for different purposes is expensive. Additionally, using several bows means an archer has to become familiar with each bow for shooting accuracy, which is inefficient and difficult for most archers.

Accordingly, it would be desirable to develop bow designs and methods to vary let off percentages and draw lengths without having to use a different bow for each particular purpose.

SUMMARY OF THE INVENTION

In one aspect, the invention includes an archery bow cam assembly having a first body and a second body discrete from the first body. The first body defines a first portion of a sheave having an eccentric profile and the second body defines a second portion of the sheave. The second body is pivotally supported on the first body and is adjustably oriented relative to the first body for adjusting the eccentric profile.

In another aspect, the invention includes an archery bow having a first limb, a second limb and a handle between the limbs. At least one rotating member is rotatably joined to at least one of the limbs, and the rotating member defines a first portion of a sheave having an eccentric profile. A body discrete from the rotating member defines a second portion of the sheave. The body is pivotally supported on the rotating member and is adjustably oriented relative to the rotating member for adjusting the eccentric profile. A string extends between the first and second limbs.

In yet another aspect, the invention includes a method of adjusting an eccentric profile of an archery bow cam assembly. A first body is provided and defines a first portion of a sheave having an eccentric profile. A second body discrete from the first body is provided pivotally supported on the first body and is adjustably oriented relative to the first body. The second body defines a second portion of the sheave. The second body is pivoted relative the first body to adjust the eccentric profile.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

An alternative to using different bows for varying let off percentages and draw lengths is to replace a rotating member in the limbs of a bow with a differently designed rotating member. For example, replacing a concentric wheel or pulley having a first radius dimension with a concentric wheel having a second radius dimension changes the draw length of the bow by taking up or letting out more cable in a cable system of the bow. Similarly, replacing an eccentric wheel or cam having a first camming periphery with a cam having a second camming periphery not only affects the draw length, but also changes the mechanical advantage of the cam as is understood by those familiar with cam design, and therefore, changes the let off percentage of the bow. However, this alternative of changing rotating members is expensive and time consuming.

The following description and claims define inventive designs and methods of varying let off percentages and draw lengths without having several bows or rotating members available.

Figure 1:
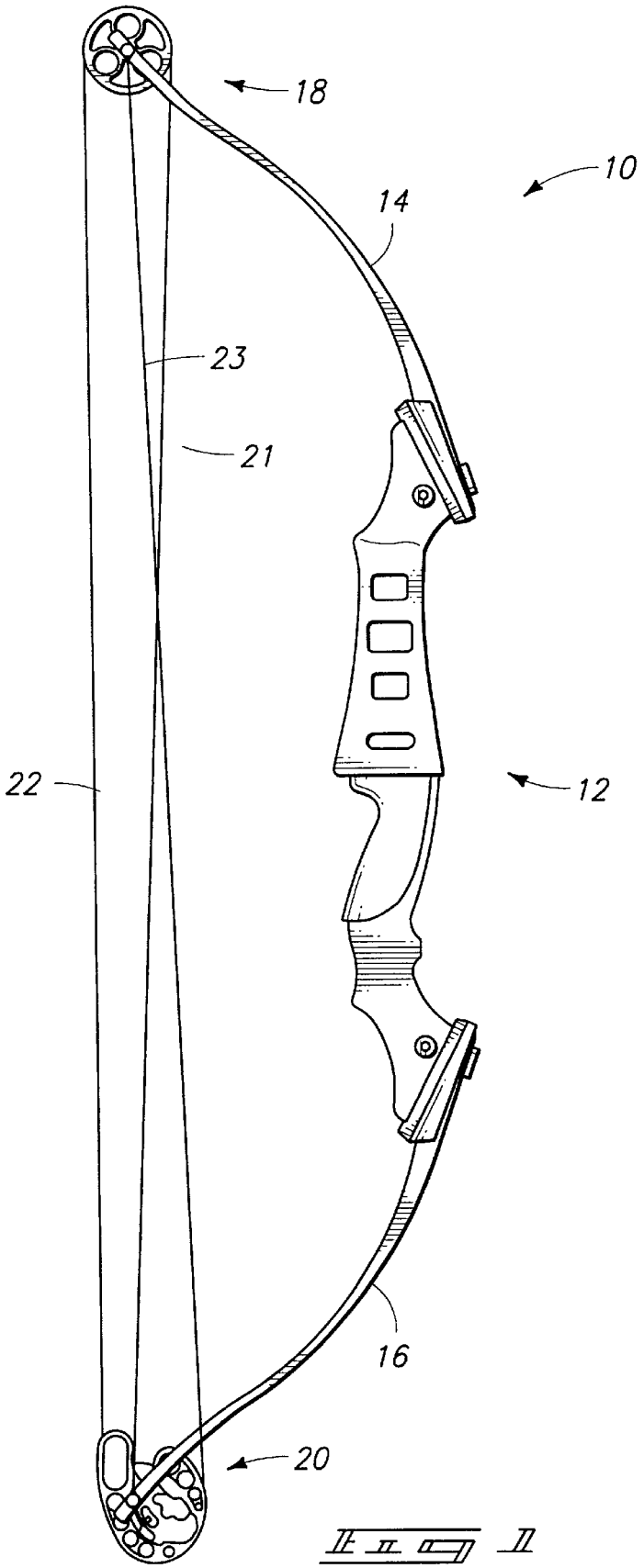
FIG. 1 is a diagrammatic side view of an archery bow in accordance with an embodiment of the present invention.

FIG. 1 shows an archery bow 10 embodiment of the present invention. Archery bow 10 comprises a handle 12, and a pair of limbs 14 and 16 attached to handle 12. Exemplary bow 10 further comprises a concentric wheel or pulley 18 rotatably attached to limb 14 and a rotating member, or cam assembly 20 rotatably attached to limb 16.

A cable, for example a string or drawstring 22, extends between limbs 14 and 16. In one embodiment, string 22 extends between pulley 18 and cam assembly 20. A plurality of cables 21 and 23, for example power cables, extend between limbs 14 and 16. It should be understood that pulley 18 and cam assembly 20 could be reversed on limbs 14 and 16. Furthermore, limb 18 could include a cam assembly 20 instead of pulley 18 such that bow 10 has a cam assembly 20 on each limb 14 and 16 respectively.

Figure 2:
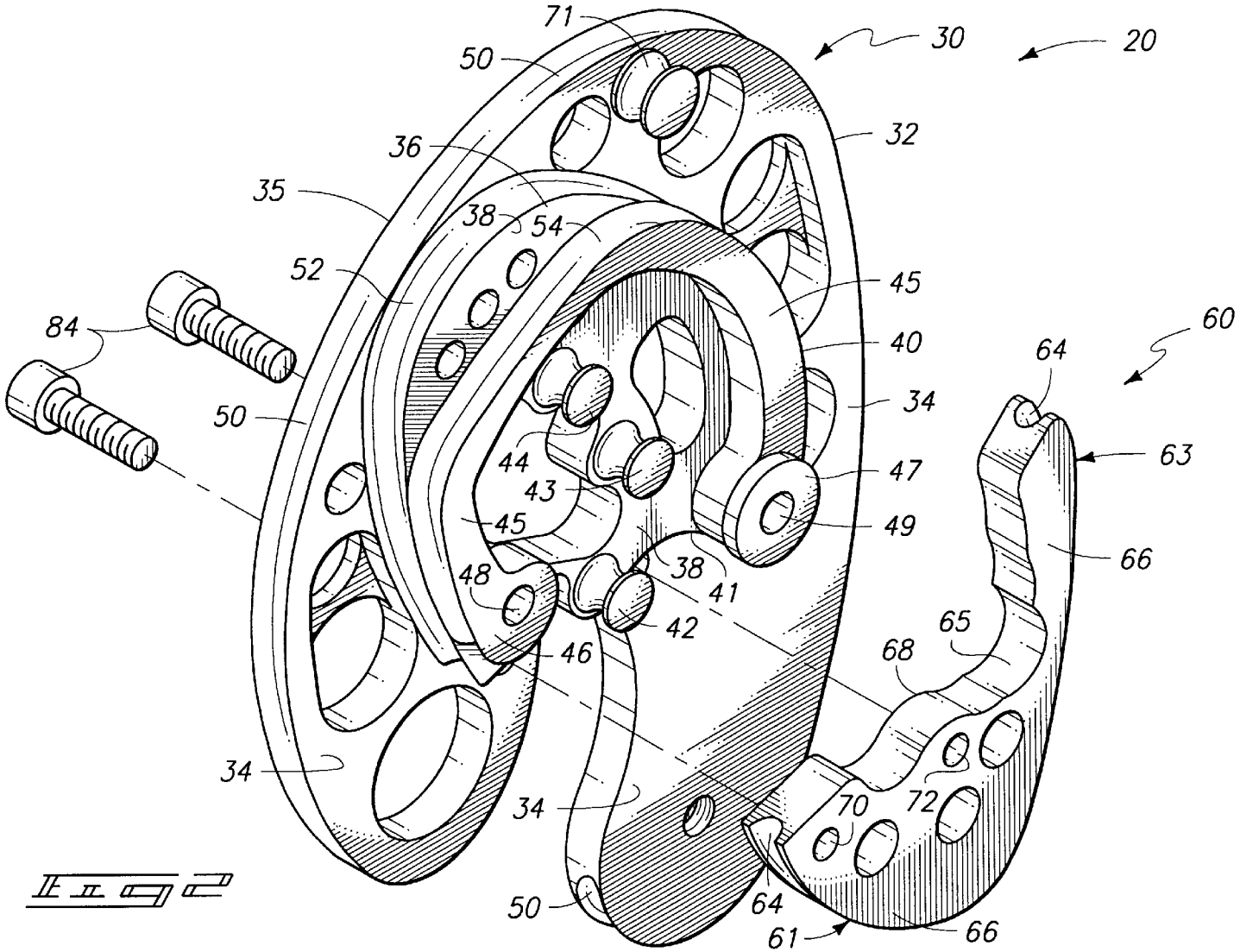
FIG. 2 is an exploded perspective view of an archery bow cam assembly in accordance with a first embodiment of the present invention.

A first embodiment of a cam assembly 20 is illustrated in FIG. 2 and comprises a first body generally indicated by numeral 30 and a second body discrete from the first body 30 generally indicated by numeral 60. First body 30 comprises a plurality of profiles with the exemplary embodiment having three eccentric profiles to form three cams, or camming surfaces. The exemplary three eccentric profiles are generally parallel. A primary cam 32 includes opposite side faces 34 and 35 with at least one cam laterally extending from side face 34, with this exemplary embodiment having two cams: a first cam 36 and a second cam 40. Primary cam 32 further includes an eccentric profile defining a first groove, or sheave 50 to provide a first camming surface between side faces 34 and 35.

First cam 36 laterally extends from the side face 34 of primary cam 32, and includes a sidewall 38 spaced from and generally parallel to side face 34 of primary cam 32. First cam 36 includes an eccentric profile defining a second groove, or sheave 52, to provide a first portion of a second camming surface between side face 34 and sidewall 38. First cam 36 further includes a peripheral edge 41 that extends laterally from side face 34 and between sheave 52.

Second cam 40 laterally extends from the sidewall 38 of first cam 36, and includes an outer wall 45 spaced from and generally parallel to sidewall 38 of first cam 36. Second cam 40 includes an eccentric profile defining a third groove, or sheave 54 to provide a third camming surface between sidewall 38 and outer wall 45. Second cam 40 defines a first terminal end 46 and a second terminal end 47. First terminal end 46 defines a first portion of an aperture 48 that extends through first cam 36 and primary cam 32. Aperture 48 is provided, for example, to reduce the weight of first body 30. Second terminal end 47 defines a first portion of an aperture, or channel 49 that extends through first cam 36 and primary cam 32. Aperture 49 receives an axle (not shown) to secure cam assembly 20 for rotational movement on bow limb 16 of bow 10. It should be understood that first body 30 could comprise any number of configurations, for example, having only one camming surface, only two camming surfaces, or more than three camming surfaces. Furthermore, it should be understood that the camming surfaces could comprise any number of peripheral configurations, for example, ovals, concentric circles, and any combination thereof.

Still referring to FIG. 2, the second body 60 defines a main structure 61 with a finger structure 63 extending from the main structure 61 and opposite side walls 66 and 68. The second body 60 includes an eccentric profile defining a fourth groove, or sheave 64 to provide a second portion of the second camming surface between side walls 66 and 68. The second body 60 further includes a peripheral edge 65 that extends between sheave 64. The main structure 61 of second body 60 further defines a first threaded opening 70 spaced from a second threaded opening 72, and the threaded openings 70 and 72 extend through the main structure 61. Threaded openings 70 and 72 are aligned axially with openings 80 and 82 (shown in FIG. 4), respectively, and receive retaining members, or threaded members 84 to secure second body 60 to first body 30. Such securement is described in more detail subsequently.

A plurality of cable anchors (for example, four shown from this perspective) 42, 43, and 44 for receiving end loops of bow cables laterally extend from the sidewall 38 of first cam 36 and are provided to accommodate different lengths of cable. A cable anchor 71 extends from side face 34 of primary cam 32.

Figure 3:
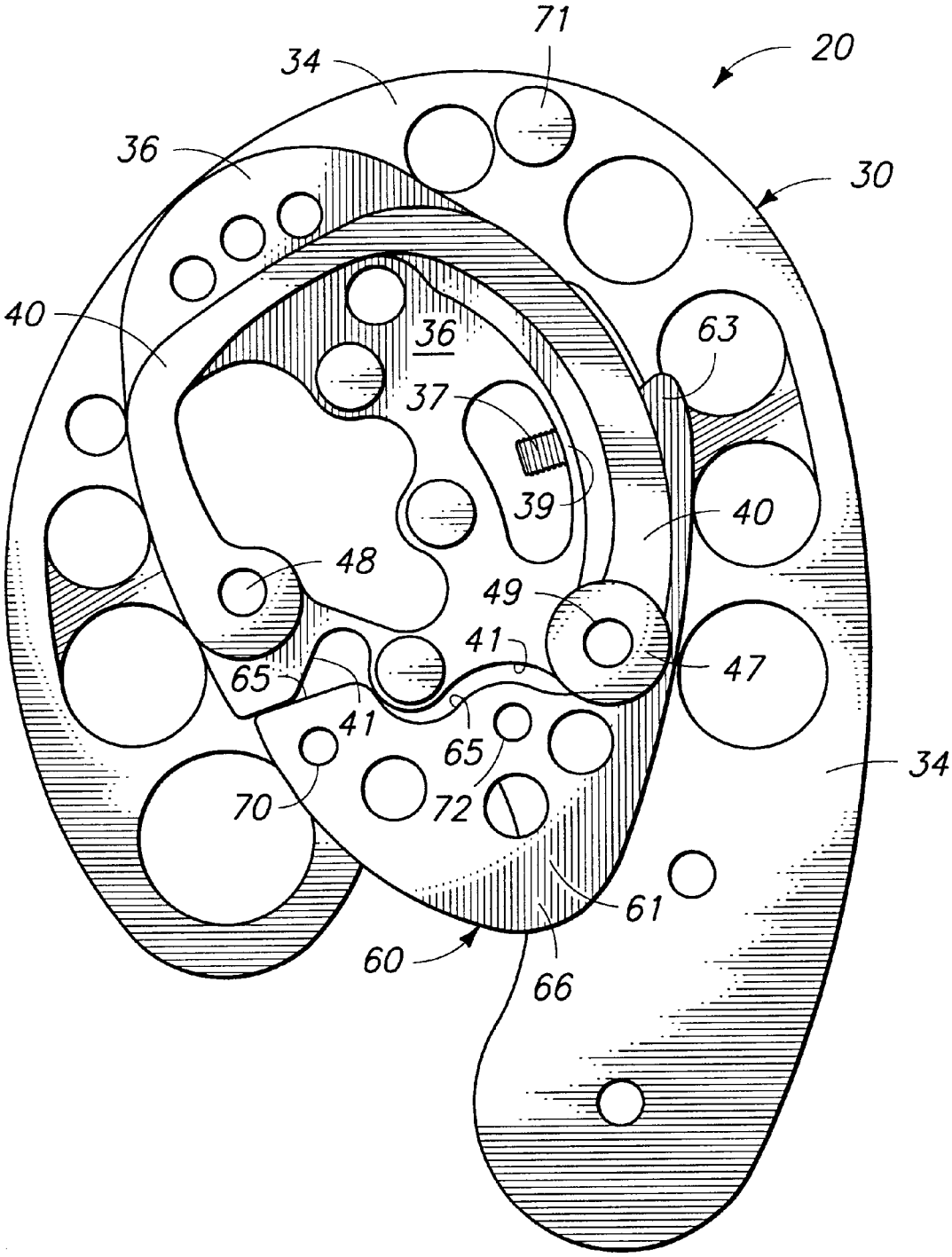
FIG. 3 is a first side view of the FIG. 2 archery bow cam assembly.
Figure 6:
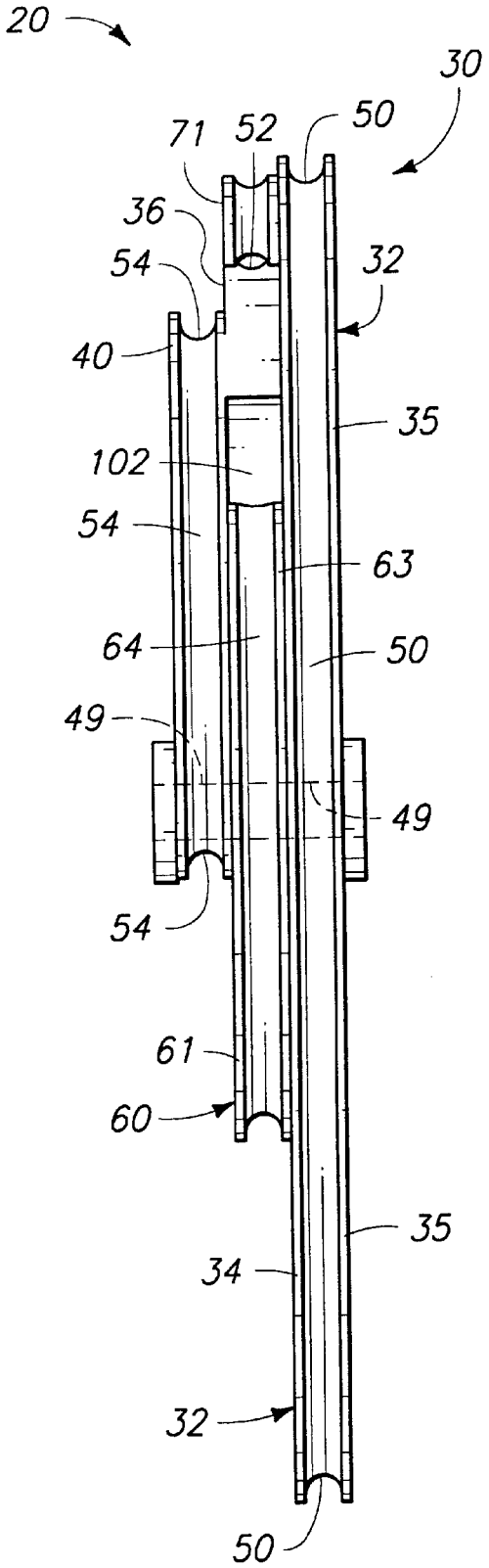
FIG. 6 is a front view of the FIG. 2 archery bow cam assembly.

Referring to FIG. 3, second body 60 is positioned adjacent first body 30 according to the present invention with second body 60 in a coplanar relationship with first cam 36 (also see FIG. 6). Such positioning places sidewall 68 of second body 60 adjacent side face 34 of first body 30. Peripheral edge 41 of first cam 36 faces proximally peripheral edge 65 of second body 60. Finger structure 63 extends past second terminal end 47 between portions of second cam 40 and primary cam 32. A first embodiment of a biasing member, for example, a threaded member 37, is threaded through a portion 39 of first cam 36 through a threaded channel (not shown), to abut against finger portion 63, and more clearly shown in FIG. 5. It should be understood that second body 60 could define a second portion of a camming surface to be aligned in a coplanar relationship with a first portion of any camming surface defined by first body 30. Furthermore, it should be understood that second body 60 could define two or more second portions of two or more camming surfaces to be aligned in a coplanar relationship with two or more first portions of any two or more camming surfaces defined by first body 30.

Figure 4:
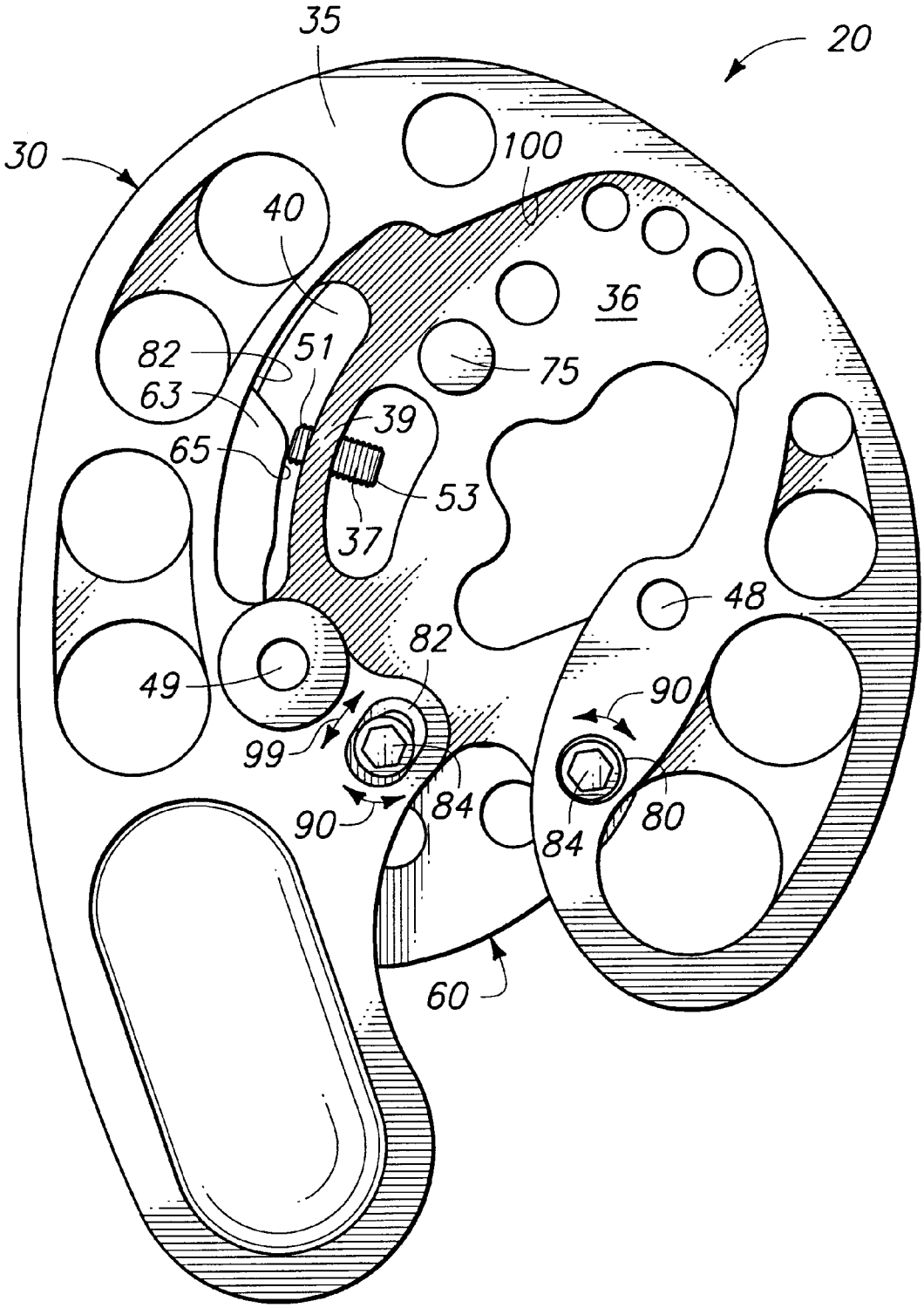
FIG. 4 is a second side view of the FIG. 2 archery bow cam assembly.

Referring to FIG. 4, side face 35 of primary cam 32 is shown comprising an opening 100 exposing a portion of first cam 36, a portion of finger structure 63 and threaded member 37. A cable anchor 75 extends from first cam 36. Threaded member 37 comprises a first end 51 opposite a second end 53, and the first end 51 abuts a portion of peripheral edge 65 of finger structure 63. Threaded member 37 biasingly supports and counteracts the forces applied to finger structure 63 created by cables under tension riding in sheave 64 of finger structure 63 by abutting against the finger structure 63 generally perpendicularly to the sheave 64 of the second body 60.

Threaded members 84 are positioned through openings 80 and 82 of primary cam 32 and threaded into threaded openings 70 and 72, respectively, of second body 60 to secure the second body 60 to first body 30. Rotating the threaded members 84 along paths 90 alternatively clockwise and counterclockwise moves the threaded members 84 axially in and out, respectively, of second body 60. Opening 82 is arcuately shaped to allow threaded member 84 to move arcuately along path 99, and path 99 defines a plane generally perpendicular to a longitudinal axis of threaded member 84. Opening 82 in the first body 30 comprises dimensions to allow the second body 60 to be pivotally adjusted relative to the first body 30 while the threaded member 84 extends through the opening 82 in the first body 30 and is threadingly secured in the aligned threaded opening 72 in the second body 60. It should be understood that other structures could be designed to counteract the forces applied to finger structure 63 created by a cables system, for example, squeeze pads secured to the cam assembly 20 and contacting opposite sides of the finger structure 63.

Figure 5:
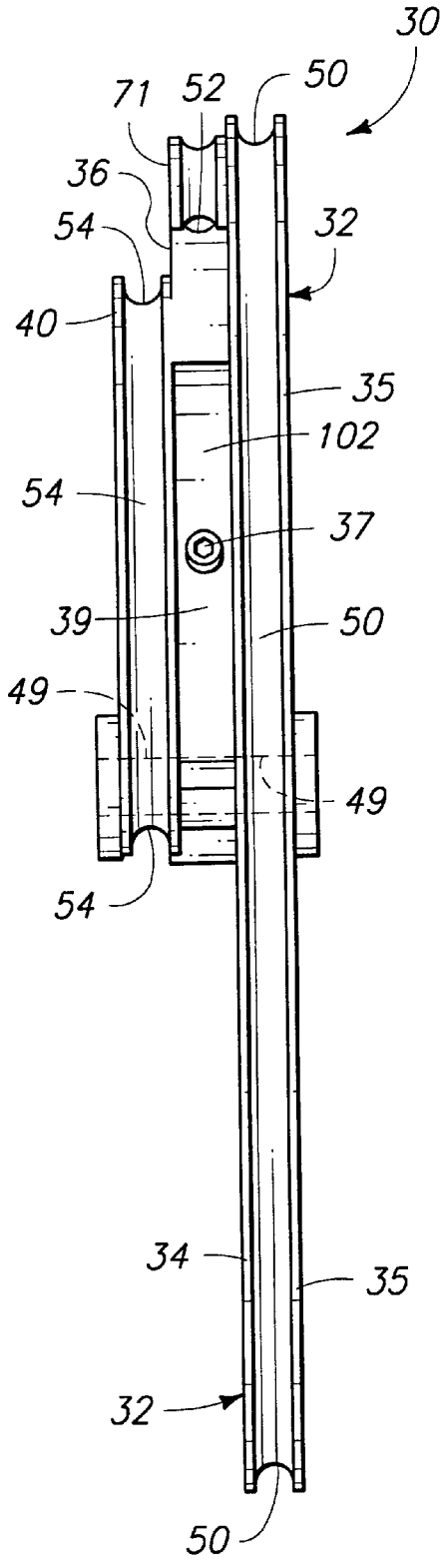
FIG. 5 is a front view of the FIG. 2 archery bow cam assembly with a discrete second body 60 removed in accordance with an embodiment of the present invention.

Referring to FIG. 5, a front view of first body 30 without second body 60 is shown. A slot 102 is defined between primary cam 32 and second cam 40 over portion 39 of first cam 36 to receive the finger portion 63 of second body 60.

Referring to FIG. 6, finger structure 63 extends toward second sheave 52 of first cam 36 in slot 102 such that sheave 64 of finger structure 63 is coplanar with sheave 52 to complete the eccentric profile of the second camming surface.

IN OPERATION

Figure 7:
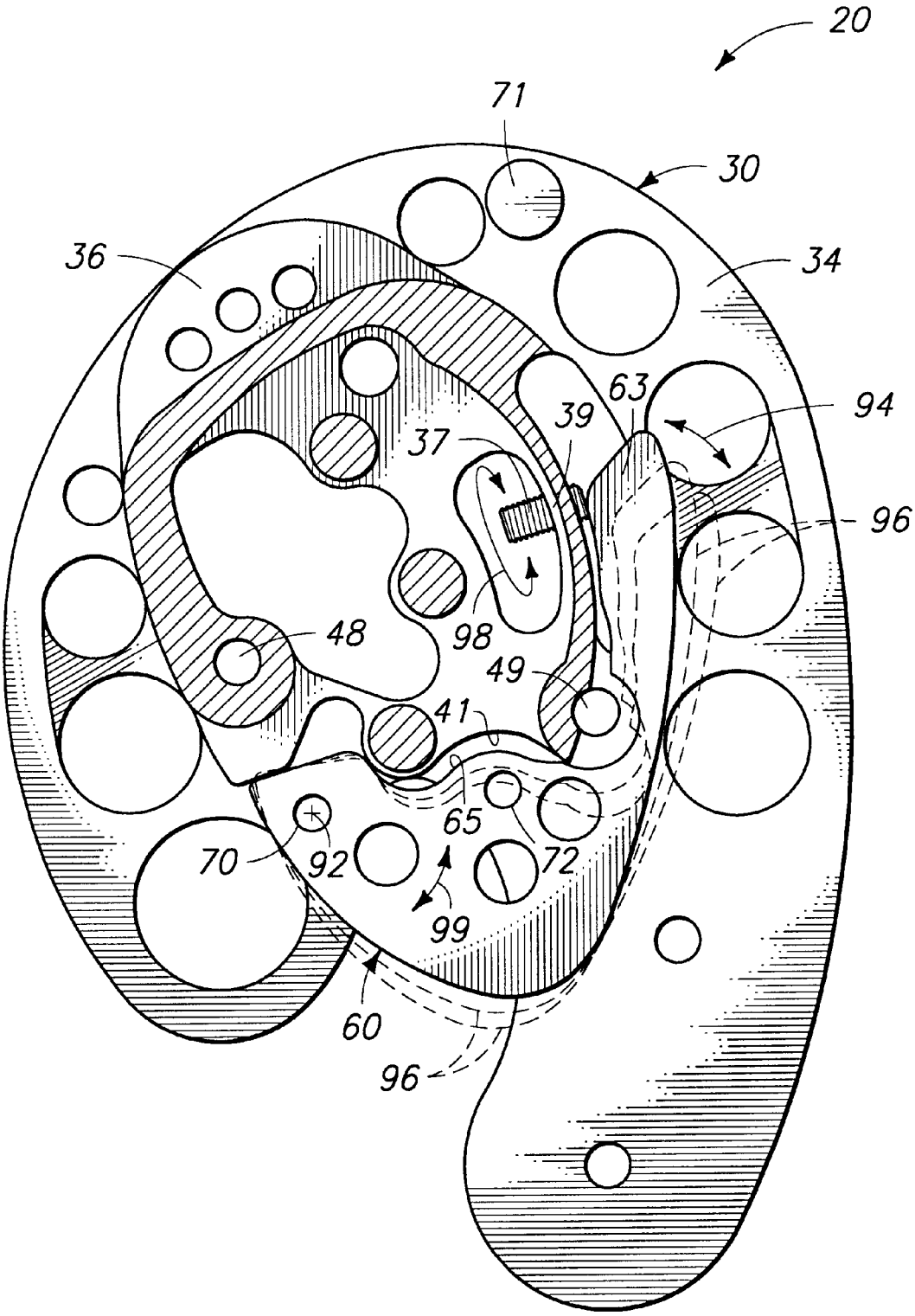
FIG. 7 is a partial sectional view of the first side of the FIG. 2 archery bow cam assembly.

A method of adjusting the eccentric profile of first cam 36 will now be described with reference to FIG. 7. It should be understood if the cam assembly 20 is rotatably secured on a bow limb with a cable system provided thereon, the tension in the cable system may need to be slacken. Threaded members 84 are removed by counterclockwise rotation along path 90 as previously described. With the threaded members 84 removed, the second body 60 is rotated about a pivot point 92 centered in threaded opening 70 along path 99. The finger structure 63 is generally moved along path 94 upon rotating the second body 60 about pivot point 92. Different possible positions 96 of second body 60 are shown in phantom. It should be understood that positions 96 are only presented for illustration purposes, and an infinite number of positions 96 are possible. As path 94 indicates, finger structure 63 can move alternatively toward or away from portion 39 of first cam 36 alternatively decreasing or increasing, respectively, the eccentric profile of second camming surface defined by sheave 52 of first cam 36 and sheave 64 of second body 60. Increasing the eccentric profile of the second camming surface would take up more length of cable riding over sheaves 52 and 64 to decrease the draw length of the bow. Additionally, increasing the eccentric profile increases the mechanical advantage of the bow and correspondingly increases the let off percentage. Alternatively, decreasing the eccentric profile increases the draw length and decreases the let off percentage.

Once a position 96 of second body 60 is selected, the threaded members 84 are tightened by clockwise motion along path 90 to secure the second body 60 to first body 30 in the selected position. Threaded member is rotated along path 98 to adjust threaded member 37 axially until it abuts finger structure 63 for biasing support.

It should be understood that the second body 60 can be positioned and secured in a substantially infinite number of incremental positions 96 within a given range of motion, the given range of motion limited by the design of the cam assembly, for example, the arcuate length of opening 82. The infinite number of incremental positions 96 is limited only by the human incapability of moving an object an infinitesimally small distance, and therefore, can be defined as a substantially infinite number.

In referring to subsequent figures, similar numbering to that utilized in describing the first embodiments will be used, with differences indicated by the suffix "a", "b", "c", or by different numerals.

Figure 8:
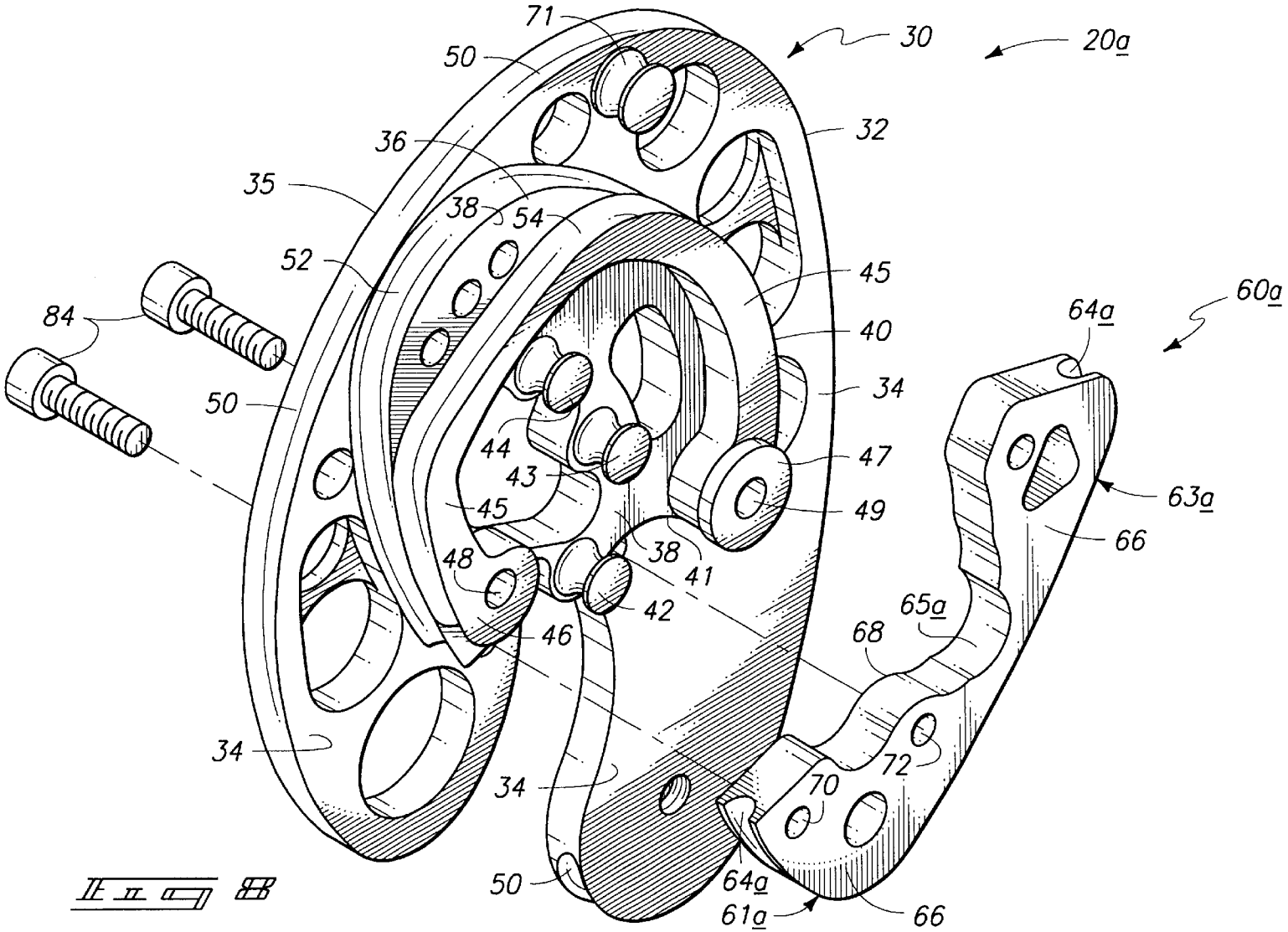
FIG. 8 is an exploded perspective view of an archery bow cam assembly in accordance with a second embodiment of the present invention.

Referring to FIG. 8, a second embodiment of a cam assembly 20*a* is illustrated and comprises a first body generally indicated by numeral 30 and a second body discrete from the first body 30 generally indicated by numeral 60*a*. An exemplary first body 30 comprises the same design as illustrated by the first embodiment of cam assembly 20 in FIGS. 2–7, and therefore, will not be described more thoroughly hereinafter. An exemplary second body 60*a* cooperates with first body 30 in substantially the same fashion as the second body 60 of the first embodiment, and comprises a main structure 61*a* and a finger structure 63*a*. However, the second embodiment differs from the first embodiment wherein second body 60*a* has a smaller-dimensioned main structure 61*a,* a larger-dimensioned finger structure 63*a,* and a flatten eccentric profile which defines a sheave 64*a.*

Figure 9:
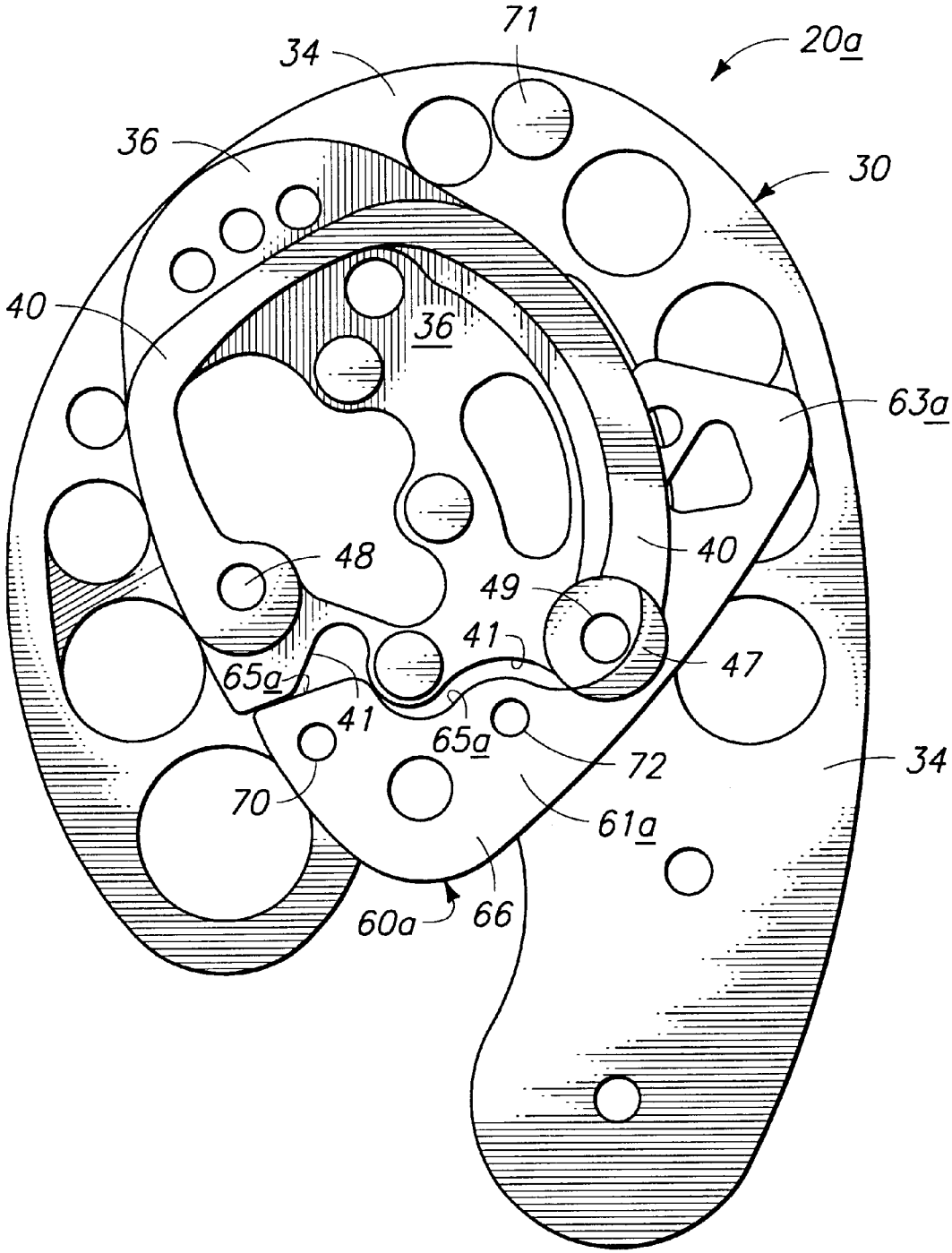
FIG. 9 is a first side view of the FIG. 8 archery bow cam assembly.

Referring to FIG. 9, second body 60*a* is positioned adjacent first body 30 in a coplanar relationship with first cam 36 similar to the first embodiment of second body 60. Peripheral edge 41 of first cam 36 faces proximally peripheral edge 65*a* of second body 60*a.* Finger structure 63*a* extends past second terminal end 47 between portions of second cam 40 and primary cam 32.

Figure 10:
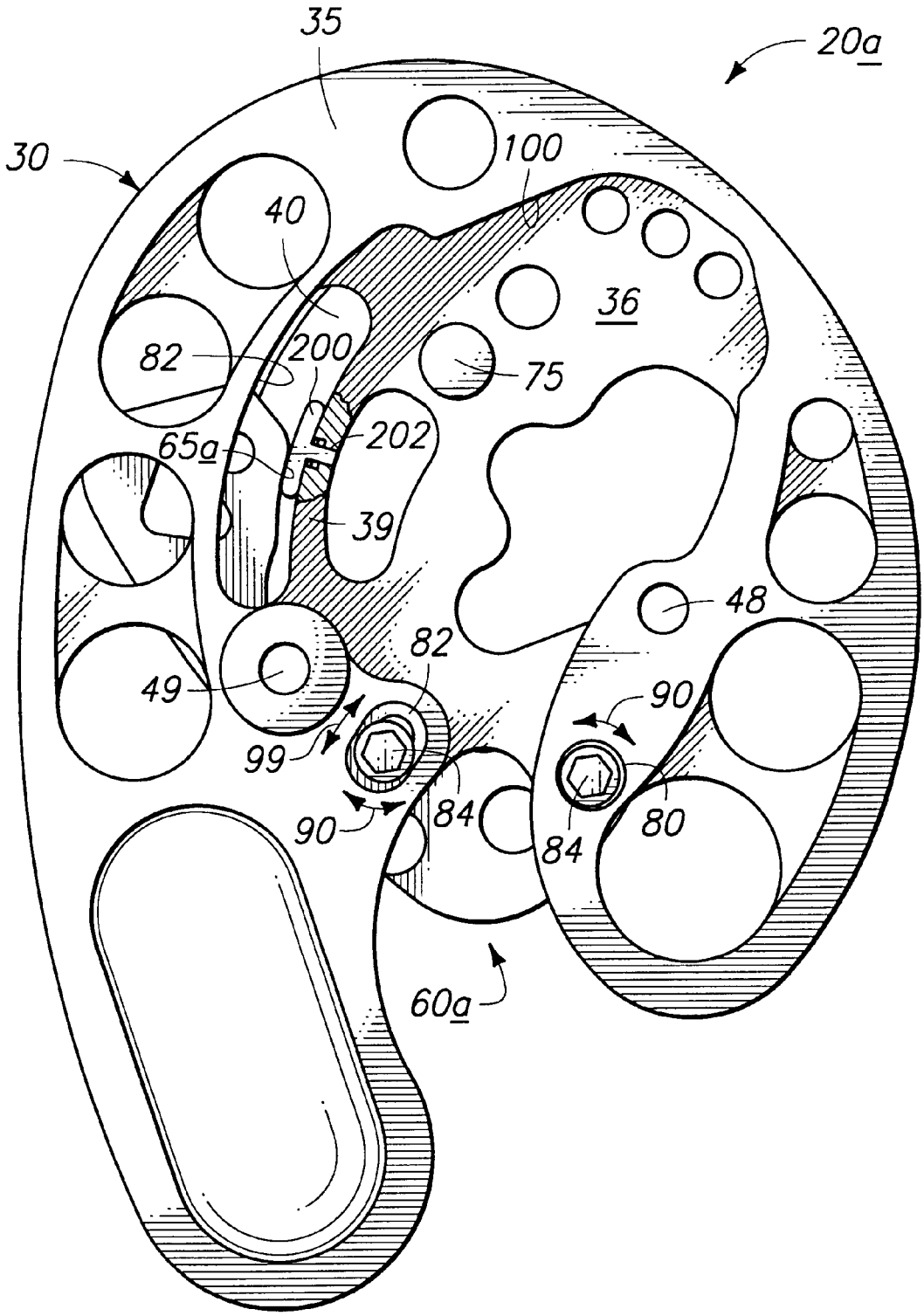
FIG. 10 is a second side view of the FIG. 8 archery bow cam assembly.

Referring to FIG. 10, an opposite side view of the FIG. 9 cam assembly 20*a* is illustrated, and showing a second embodiment of a biasing member, for example, a biasing insert 200, positioned in portion 39 of first cam 36 through an opening 202 shown in a partial cut away of portion 39.

Figure 11:
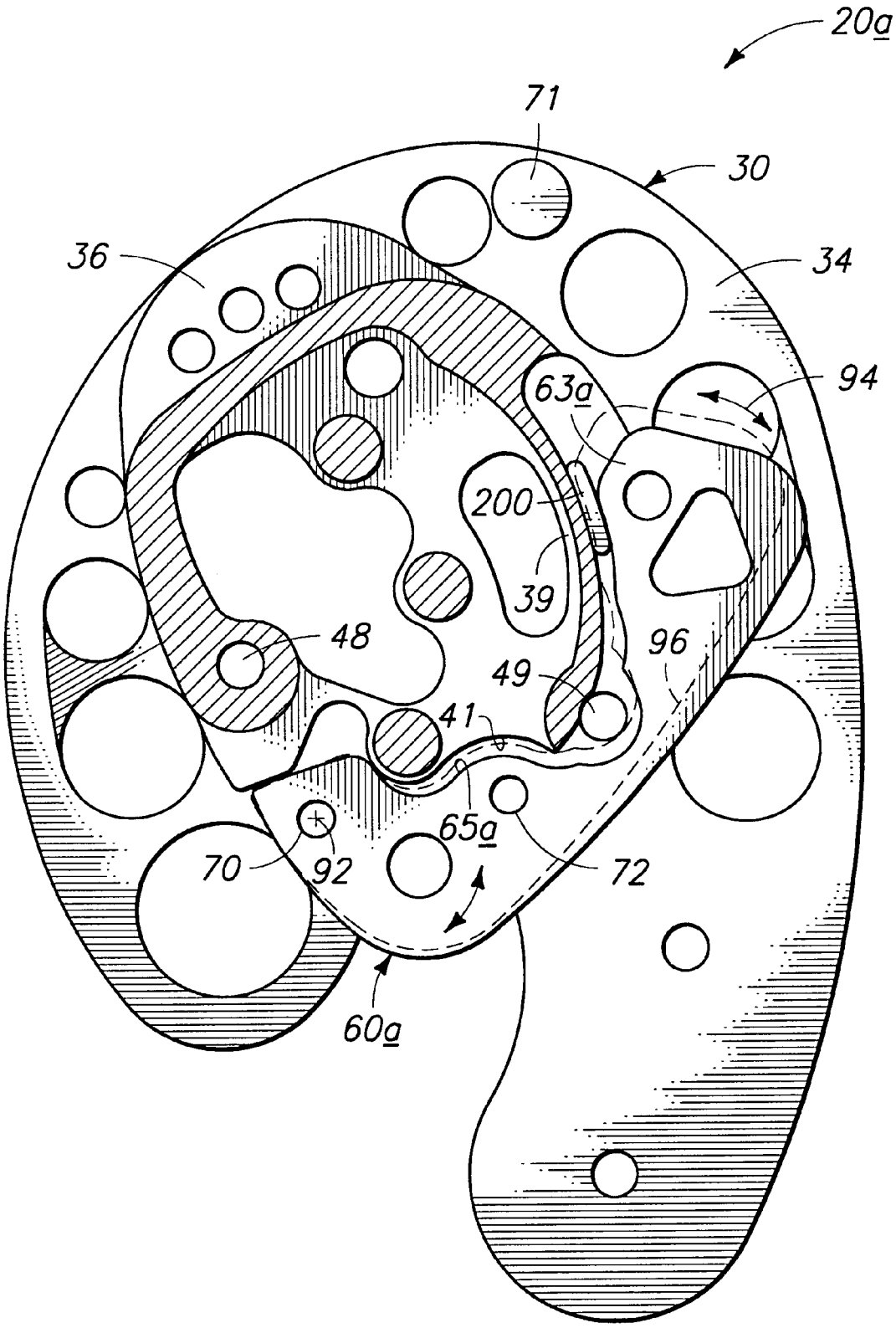
FIG. 11 is a partial sectional view of the first side of the FIG. 8 archery bow cam assembly.

Referring to FIG. 11, a partial sectional of the FIG. 9 cam assembly 20*a* further illustrates biasing insert 200. A method of adjusting the eccentric profile of first cam 36*a* is substantially similar to adjusting the eccentric profile of first cam 36 for the first embodiment of cam assembly 20, and therefore, is not further described hereinafter. Biasing insert 200 abuts against peripheral edge 65*a* of finger portion 63*a.* An exemplary composition of material for biasing insert 200 includes at least one from a group of metals, plastics, fiberglass, nylon, nylon with glass fill, and other polymers capable of handling forces exerted by finger portion 63*a,* and any combination of the listed materials. For example, biasing insert 200 includes a composition of nylon with glass fill wherein the glass fill comprises a percentage by weight ranging from 5 to 50 percent. An exemplary percentage by weight of the glass fill is 40%. An exemplary nylon would be Nylon 66 manufactured by DuPont® Company. The larger-dimensioned finger portion 63*a* (relative the finger portion of the first embodiment) provides the peripheral edge 65*a* spaced a greater distance from the sheave 64*a.* Accordingly, when finger portion 63*a* abuts against biasing insert 200, sheave 64*a* is spaced a greater distance from portion 39 of the first body 30 (relative the sheave 64 of the first embodiment) to provide a camming surface with a different eccentric profile as compared to the first embodiment. The different eccentric profile provides a different let off percentage.

It should be understood that the biasing insert 200 is removably secured in the first body 30 for abutting engagement with the second body 60*a* generally perpendicularly relative to the sheave 64*a* of the second body 60*a* for maintaining the second body 60*a* in selective orientations relative the first body 60*a.* Accordingly, the eccentric profile of the camming surface established by positioning the second body 60*a* with the first body 30 is selectively adjusted by inserting different discrete biasing inserts 200 having different dimensions (described more thoroughly hereinafter) in first body 30*a.* It should be understood that biasing insert 200 may be removed from opening 202 of first body 30 to allow peripheral edge 65*a* of finger portion 63*a* to abut against portion 39 of first body 30 to establish an eccentric profile different from the eccentric profile produced with the biasing insert 200 is received in opening 202. Accordingly, the corresponding let off percentages are different for the different eccentric profiles.

Figure 12:
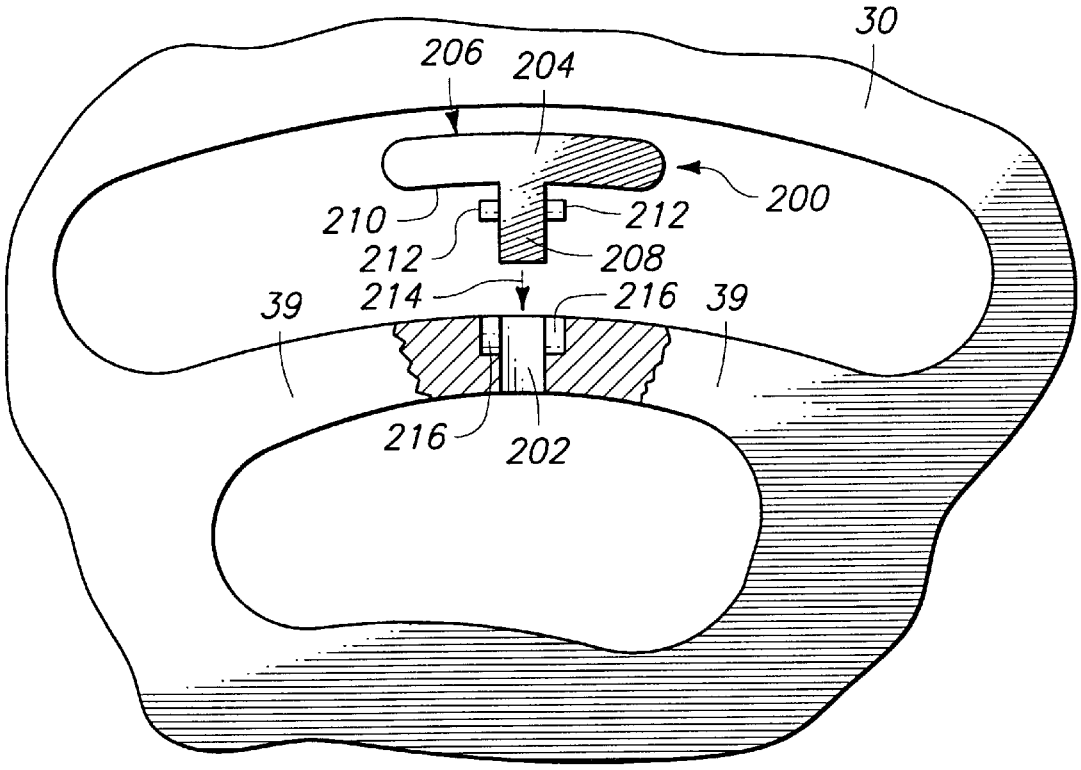
FIG. 12 is a fragmentary side view of a partially broken-away first body of the FIG. 8 archery bow cam assembly, and shown with a front elevational view of a biasing insert in accordance with a first embodiment of the present invention.

Referring to FIGS. 12–17, embodiments of biasing inserts 200, and openings 202 defined by first body 30, are described. Referring to FIG. 12, a first embodiment of biasing insert 200 is shown, and includes a fragmentary view of first body 30 with portion 39 partially broken away to more fully illustrate opening 202. Biasing insert 200 includes generally an elongate portion 204 which defines an upper receiving surface 206 and a plug portion 208 extending generally perpendicularly downwardly from a side 210 of elongate portion 204 opposite upper receiving surface 206. A pair of nodules 212 extend laterally from opposite sides of plug portion 208 and define an axis which is generally parallel and spaced from an axis defined by elongate portion 204. Opening 202 is defined by portion 39 of first body 30 to complement the design of plug portion 208 such that plug portion 208 is securely received in opening 202 when biasing insert 200 is moved along direction arrow 214 for insertion therein. Portion 39 further defines a pair of slots or grooves 216 formed outward of opposite sides of opening 202 to receive nodules 212 for further securement of biasing insert 200.

Figure 13:
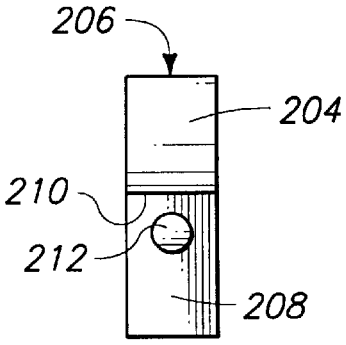
FIG. 13 is a side elevational view of the FIG. 12 biasing insert.
Figure 14:
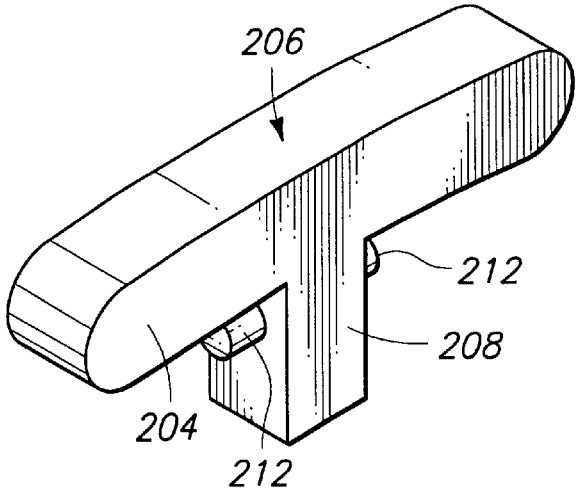
FIG. 14 is a perspective view of the FIG. 12 biasing insert.

Referring to FIGS. 13–14, biasing insert 200 is shown with a rectangular side profile and elongate portion 204 defining curved opposite ends.

Figure 15:
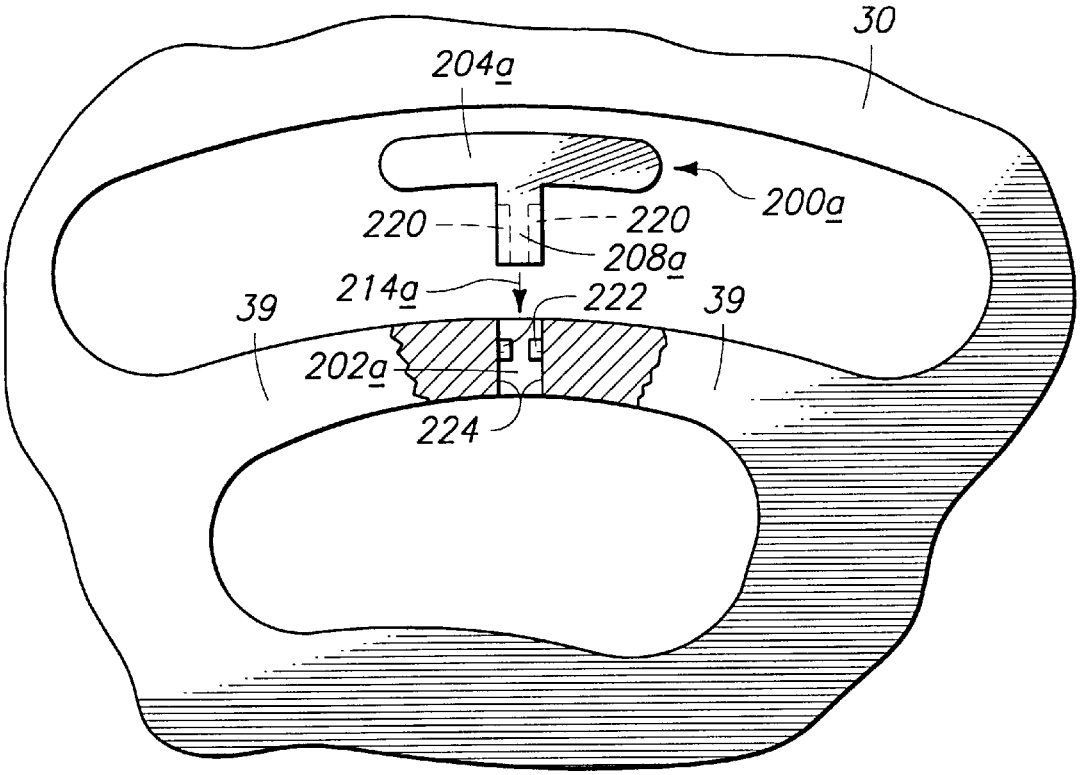
FIG. 15 is a fragmentary side view of a partially broken-away first body of the FIG. 8 archery bow cam assembly, and shown with a front elevational view of a biasing insert in accordance with a second embodiment of the present invention.
Figure 16:
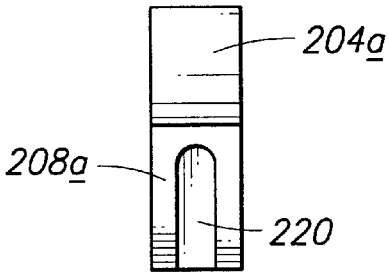
FIG. 16 is a side elevational view of the FIG. 15 biasing insert.
Figure 17:
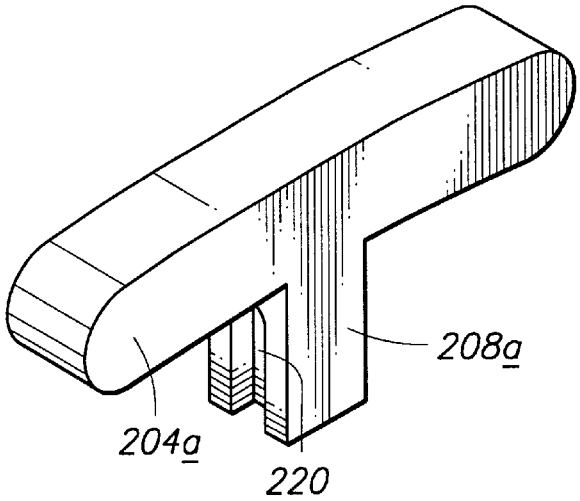
FIG. 17 is a perspective view of the FIG. 15 biasing insert.

Referring to FIGS. 15–17, a second embodiment of biasing insert 200*a* is shown. Biasing insert 200*a* includes an elongate portion 204*a* and a plug portion 208*a* extending generally perpendicularly downwardly from elongate portion 204*a.* Opposite sides of plug portion 208*a* define slots or grooves 220 extending axially parallel with plug portion 208*a.* Portion 39 of first body 30 defines opening 202*a* with sidewalls 224 and a pair of nodules 222 collinearly extending inwardly from sidewalls 224. Plug portion 208*a* is securely received in opening 202*a* when biasing insert 200*a* is moved along direction arrow 214*a* for insertion therein with slots 220 riding over nodules 222 for further securement of biasing insert 200.

It should be understood that plug 208 could be designed with any number of configurations such that opening 202 is correspondingly designed to receive plug 208 in a complementary fashion. For example, referring to FIGS. 15–17, portion 39 could define opening 202*a* to be accessed from the side of first body 30, that is, perpendicularly to the page. Such design would include slots 220 to be oriented perpendicularly to that as shown along an axis extending out of the page to allow sliding cooperation of slots 220 over nodules 222 upon positioning biasing insert 200*a* by moving same along the axis extending out of the page. Furthermore, it should be understood that elongate portion 204 could be designed with any number of configurations, for example, providing biasing inserts 200 with different dimensions of the elongate portion 204 between the upper receiving surface 206 and side 210 (this is, the height dimension above portion 39). Such different dimensions allows for varying the eccentric profile of the corresponding camming surface when second body 60 abuts against upper receiving surface 206 wherein let off percentages are correspondingly varied.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An archery bow cam assembly, comprising:

a first body defining a first portion of a sheave having an eccentric profile;

a second body discrete from the first body and defining a second portion of the sheave, the second body pivotally supported on the first body and being adjustably oriented relative to the first body for adjusting the eccentric profile; and at least one retaining member adjustably securing the second body to the first body about an axis, and wherein the at least one retaining member adjustably secures the second body to the first body about the axis in a substantially infinite number of increment positions relative the first body.

2. The assembly of claim 1 wherein the first body defines a plurality of discrete sheaves.

3. The assembly of claim 1 wherein the first body defines more than two discrete sheaves having eccentric profiles.

4. The assembly of claim 1 wherein the first body defines at least three discrete sheaves, and wherein the first and second portions of the sheave having the eccentric profile comprise a central sheave between the other two sheaves.

5. The assembly of claim 1 further comprising a biasing member adjustably secured in the first body and abutting the second body generally perpendicularly relative to the sheave of the second body to bias the second body.

6. The assembly of claim 5 wherein the biasing member comprises a threaded member secured in a threaded opening in the first body, and the threaded member comprising an end to abut against the second body generally perpendicularly to the sheave of the second body.

7. The assembly of claim 1 wherein the retaining member comprises a threaded member, and wherein the first and second bodies define openings aligned to receive the threaded member.

8. The assembly of claim 7, wherein the first body defines a channel to receive an axle for rotational securement to a bow limb, and the channel is spaced from the opening to receive the threaded member.

9. The assembly of claim 1 wherein the at least one retaining member comprises a first retaining member defining the pivotal axis of the second body relative to the first body, and further comprising a second retaining member defining another axis spaced from the pivotal axis, the first and second retaining members adjustably securing the second body to the first body.

10. The assembly of claim 9 wherein the first and second retaining members adjustably secure the second body to the first body in a substantially infinite number of increment positions relative the first body.

11. The assembly of claim 9 wherein the first and second retaining members comprise threaded members received in aligned openings defined by the first and second bodies, and wherein the openings in the second body are threaded openings complementary to the threads on the threaded members, wherein the threaded members extend through the openings of the first body and thread into the threaded openings of the second body.

12. The assembly of claim 11 wherein the opening in the first body that receives the second retaining member comprises dimensions to allow the second body to be pivotally adjusted relative to the first body while the second retaining member extends through the opening in the first body and is threadingly secured in the aligned threaded opening in the second body.

13. The assembly of claim 1 wherein: the at least one retaining-member comprises a first retaining member defining the pivotal axis of the second body relative to the first body, and further comprising a second retaining member defining another axis spaced from the pivotal axis, and the first and second retaining members adjustably securing the second body to the first body; and the first body defines a channel to receive an axle for rotational securement to a bow limb, and the channel defines an axis spaced from the pivotal axis.

14. The assembly of claim 13 wherein the first and second retaining members adjustably secure the second body to the first body in a substantially infinite number of increment positions.

15. An archery bow cam assembly, comprising:

a first body defining a first portion of a sheave having an eccentric profile;

a second body discrete from the first body and defining a second portion of the sheave, the second body pivotally supported on the first body and being adjustably oriented relative to the first body for adjusting the eccentric profile; and a biasing member removably secured in the first body for abutting engagement with the second body generally perpendicularly relative to the sheave of the second body, the biasing member maintaining the second body in selective orientations relative the first body.

16. The assembly of claim 15 wherein the biasing member comprises a composition of at least one material from a group of metals, plastics, fiberglass, nylon, and nylon with glass fill.

17. The assembly of claim 15 wherein the biasing member comprises a composition of nylon with glass fill wherein the glass fill comprises a percentage by weight ranging from 5 to 50 percent.

18. An archery bow comprising:

a first limb and a second limb;

a handle between the limbs;

at least one rotating member rotatably joined to at least one of the limbs, the rotating member defining a first portion of a first sheave having an eccentric profile;

a body discrete from the rotating member and defining a second portion of the first sheave, the body pivotally supported on the rotating member and being adjustably oriented relative to the rotating member for adjusting the eccentric profile;

a string extending between the first and second limbs; and a first retaining member adjustably securing the discrete body to the rotating member about an axis, wherein the first retaining member adjustably secures the discrete body to the rotating member in a substantially infinite number of increment positions.

19. The bow of claim 18 wherein the rotating member defines at least two sheaves other than the second portion of the first sheave, and wherein the first and second portions of the first sheave having the eccentric profile comprises a central sheave between the other two sheaves.

20. The bow of claim 18 further comprising a biasing member adjustably secured in the rotating member and abutting the discrete body generally perpendicularly relative to the second portion of the first sheave defined by the discrete body to bias the discrete body.

21. The bow of claim 18 wherein the first retaining member defines the pivotal axis of the discrete body relative to the rotating member, and further comprising a second retaining member defining another axis spaced from the pivotal axis, the first and second retaining members adjustably securing the discrete body to the rotating member.

22. The bow of claim 18 wherein:

the first retaining member defines the pivotal axis of the discrete body relative to the rotating member, and a second retaining member defining another axis spaced from the pivotal axis, and the first and second retaining members adjustably securing the discrete body to the rotating member; and the rotating member defines a channel to receive an axle for rotational securement to a bow limb, and the channel defines an axis spaced from the pivotal axis.

23. A method of adjusting an eccentric profile of an archery bow cam assembly, comprising:

providing a first body defining a first portion of a sheave having an eccentric profile;

providing a second body discrete from the-first body and defining a second portion of the sheave, the second body being pivotally supported on the first body and being adjustably oriented relative to the first body;

pivoting the second body relative the first body to adjust the eccentric profile;

providing at least one retaining member adjustably securing the second body to the first body about the pivot axis;

after pivoting the second body, adjusting the at least one retaining member to secure the second body to the first body; and wherein the at least one retaining member adjustably secures the second body to the first body in a substantially infinite number of increment positions.

24. The method claim of 23 further comprising:

providing a biasing member adjustably secured in the first body; and adjusting the biasing member to abut the second body generally perpendicularly relative to the sheave of the second body to bias the second body.

25. The method claim of 23 further comprising providing a discrete biasing member removably secured in the first body and abutting the second body generally perpendicularly relative to the sheave of the second body to maintain the second body in selective orientations relative the first body.

26. The method claim of 25 further comprising providing a plurality of discrete biasing members wherein each has different dimensions to provide the selective adjustable orientation of second body relative to first body when one of the plurality of discrete biasing members is secured in the first body.

27. The method claim of 23 wherein the at least one retaining member comprises a first retaining member defining the pivotal axis of the second body relative to the first body, and further comprising a second retaining member defining another axis spaced from the pivotal axis.

28. The method claim of 27 wherein the first and second retaining members adjustably secure the second body to the first body in a substantially infinite number of increment positions.

29. The method claim of 27 wherein the first and second retaining members comprise threaded members received in aligned openings defined by the first and second bodies, and wherein the openings in the second body are threaded openings complementary to the threads on the threaded members wherein the threaded members extend through the openings of the first body and thread into the threaded openings of the second body.

30. The method claim of 29 further comprising:

before pivoting the second body, removing the threaded members from the first and second bodies; and after pivoting the second body, replacing the threaded members in the first and second bodies to secure the second body relative to the first body.

* * * * *